US007852361B2

(12) United States Patent
Shoji et al.

(10) Patent No.: US 7,852,361 B2
(45) Date of Patent: Dec. 14, 2010

(54) HEATING RESISTANCE ELEMENT COMPONENT AND PRINTER

(75) Inventors: Noriyoshi Shoji, Chiba (JP); Toshimitsu Morooka, Chiba (JP); Norimitsu Sanbongi, Chiba (JP); Yoshinori Sato, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 241 days.

(21) Appl. No.: 12/286,873

(22) Filed: Oct. 2, 2008

(65) Prior Publication Data

US 2009/0262176 A1 Oct. 22, 2009

(30) Foreign Application Priority Data

Oct. 10, 2007 (JP) ..... 2007-263935

(51) Int. Cl.
*B41J 2/335* (2006.01)

(52) U.S. Cl. ..... 347/206

(58) Field of Classification Search ..... 347/200, 347/206, 207

See application file for complete search history.

(56) References Cited

U.S. PATENT DOCUMENTS 5,357,271 A * 10/1994 Wiklof et al. ..... 347/197
5,940,109 A * 8/1999 Taniguchi et al. ..... 347/205
5,949,465 A * 9/1999 Taniguchi et al. ..... 347/205
7,522,178 B2 * 4/2009 Shoji et al. ..... 347/205

FOREIGN PATENT DOCUMENTS

JP 2007-083352 * 4/2007

* cited by examiner

*Primary Examiner*—Huan H Tran
(74) *Attorney, Agent, or Firm*—Adams & Wilks

(57) ABSTRACT

Provided is a heating resistance element component, including: a supporting substrate; an insulating film laminated on the supporting substrate; a plurality of heating resistors formed on the insulating film, the plurality of heating resistors being arranged in a zigzag shape along a main scanning direction and having a substantially square shape; a common wire connected to one end of each of the plurality of heating resistors; individual wires each connected to another end of the each of the plurality of heating resistors; and concave portions formed in regions which are opposed to the plurality of heating resistors and are located on a surface of the supporting substrate, in which an arrangement pitch of the plurality of heating resistors in a sub-scanning direction is larger than an arrangement pitch of the plurality of heating resistors in a main scanning direction.

9 Claims, 4 Drawing Sheets

HEATING RESISTANCE ELEMENT COMPONENT AND PRINTER

BACKGROUND OF THE INVENTION

1. Field of the Invention

The present invention relates to a heating resistance element component (thermal head) which is used in a thermal activation device, and selectively drives a plurality of heating elements based on thermal activation data to thermally activate a thermosensitive adhesive layer provided on a rear side of a sheet-like base.

2. Description of the Related Art

There is generally known a thermal activation device which performs recording and thermal activation to a thermal activation starchy sheet including a thermosensitive adhesive layer formed on a rear surface side of a recording surface of a sheet-like base. The thermosensitive adhesive layer is formed of, for example, a material which is not adhesive at about room temperature but expresses adhesion through thermal activation by being heated to about 50 to 150° C. In the thermal activation, a large area needs to be heated to obtain adhesion, which requires a considerable amount of thermal energy. Therefore, in order to avoid a problem such as an increase in temperature of an entire device and decreased operating time when powered by battery, for example, it is desirable that a thermal head consuming little electric power, which is disclosed in JP 2007-83532 A, be used in the aforementioned thermal activation device.

The thermal head disclosed in JP 2007-83532 A is formed with a hollow portion in a region opposed to a heating portion of a heating resistor. Ideally, the hollow portion should be provided over a region much larger than a region where the heating resistor is formed. However, when the hollow portion is provided in the region much larger than the region where the heating resistor is formed, a mechanical strength of a substrate decreases.

In addition, when the mechanical strength of the substrate is intended to be sufficiently ensured, the hollow portion cannot be formed in the region much larger than the region where the heating resistor is formed. As a result, heat generated in the heating element diffuses over the entire substrate, which results in a decrease in heating efficiency.

SUMMARY OF THE INVENTION

The present invention has been made in view of the aforementioned circumstances, and an object thereof is to provide a heating resistance element component capable of increasing heating efficiency of a heating resistor to reduce power consumption and increasing a strength of a substrate under the heating resistor, and a printer.

In order to solve the aforementioned problems, the present invention employs the following means.

The heating resistance element component according to the present invention includes: a supporting substrate; an insulating film laminated on the supporting substrate; a plurality of heating resistors formed on the insulating film, the plurality of heating resistors being arranged in a zigzag shape along a main scanning direction and having a substantially square shape; a common wire connected to one end of each of the plurality of heating resistors; individual wires each connected to another end of the each of the plurality of heating resistors; and concave portions formed in regions which are opposed to the plurality of heating resistors and are located on a surface of the supporting substrate. In the heating resistance element component, an arrangement pitch of the plurality of heating resistors in a sub-scanning direction is larger than an arrangement pitch of the plurality of heating resistors in a main scanning direction.

According to the heating resistance element component of the present invention, the plurality of heating resistors are formed (arranged) in the zigzag shape along the main scanning direction, and the arrangement pitch of the plurality of heating resistors in the sub-scanning direction are set to be larger than the arrangement pitch of the plurality of heating resistors in the main scanning direction, with the result that a partition wall which functions as a supporting material supporting pressing force applied from surfaces (for example, upper surfaces in FIG. 2) of the heating resistors is formed between the adjacent concave portions.

Thus, even when the pressing force is applied from the surface side of the heating resistors during printing or the like, the partition wall formed between the adjacent concave portions supports the pressing force. As a result, the mechanical strength of the substrate can be increased, which leads to an increase in pressure tightness thereof.

Besides, hollow portions (void heat insulating layers) larger than conventional hollow portions can be formed (arranged) directly below the heating resistors (in regions opposed to heating portions of the heating resistors), and hence heat (amount of heat) generated in the heating resistors can be prevented from flowing into the substrate, whereby the heating efficiency of the heating resistors can be increased. As a result, power consumption can be reduced.

More preferably, a width of the plurality of heating resistors in the main scanning direction is equal to or larger than the arrangement pitch of the plurality of heating resistors in the main scanning direction.

According to the aforementioned heating resistance element component, the width of the plurality of the heating resistors in the main scanning direction is made equal to or larger than the arrangement pitch of the plurality of the heating resistors in the main scanning direction, and thus similar effects as in the case where the heating resistors are arranged without intervals along the main scanning direction can be obtained. In other words, a thermosensitive adhesive layer of a sheet material can be thermally activated evenly along a width direction of the sheet material.

In the heating resistance element component, more preferably, a width of the concave portions in the main scanning direction is larger than the arrangement pitch of the plurality of heating resistors in the main scanning direction.

According to the aforementioned heating resistance element component, the adjacent concave portions are formed to overlap each other in the main scanning direction, and thus the heat (amount of heat) generated in the plurality of heating resistors can be further prevented from flowing into the substrate. Therefore, the heating efficiency of the plurality of heating resistors can be further increased, which leads to a further reduction in consumption power.

In the aforementioned heating resistance element component, more preferably, one of a width of the common wire and a width of the individual wires is smaller in an area adjacent to the heating portions of the plurality of heating resistors along the main scanning direction than the one of the width of the common wire and the width of the individual wires in an area located in a vicinity of the heating portions of the plurality of heating resistors.

According to the aforementioned heating resistance element component, the heating resistors can be in smooth contact with the sheet material.

A thermal activation device and a printer according to the present invention include the heating resistance element component which increases the heating efficiency of the heating resistors and reduces the power consumption to increase the strength of the supporting substrate under the heating resistors. Accordingly, the thermosensitive adhesive layer of the sheet material can be thermally activated with less electric power, with the results that battery life can be extended and the reliability of the entire printer can be increased.

According to the present invention, there can be attained effects that the heating efficiency of the heating resistors can be increased to reduce the power consumption, and that the strength of the substrate under the heating resistors can be increased.

DETAILED DESCRIPTION OF THE PREFERRED EMBODIMENTS

Hereinafter, a heating resistance element component according to a first embodiment of the present invention is described with reference to FIG. 1 and FIG. 2.

Figure 1:
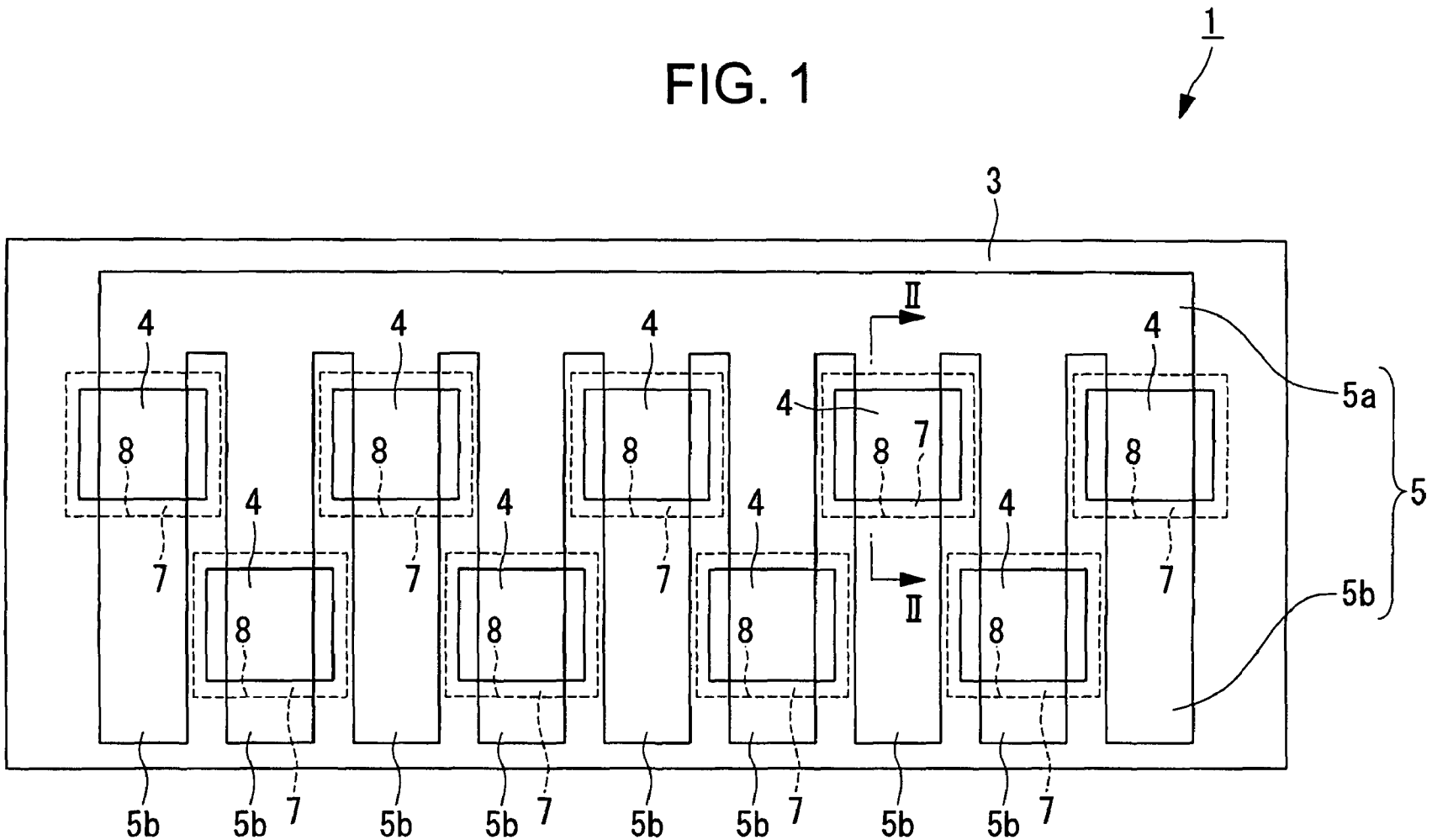
FIG. 1 is a plan view of a thermal head according to a first embodiment of the present invention, which shows a state where a protective film is removed.

FIG. 1 is a plan view of a thermal head which is a heating resistance element component according to this embodiment, which shows a state where a protective film is removed. FIG. 2 is a sectional view taken along an arrow II-II of FIG. 1.

A heating resistance element component 1 according to this embodiment is, for example, a thermal head used in a thermal activation device 25 (see FIG. 4) using a thermosensitive adhesive label (hereinafter, referred to as "thermal head").

Figure 2:
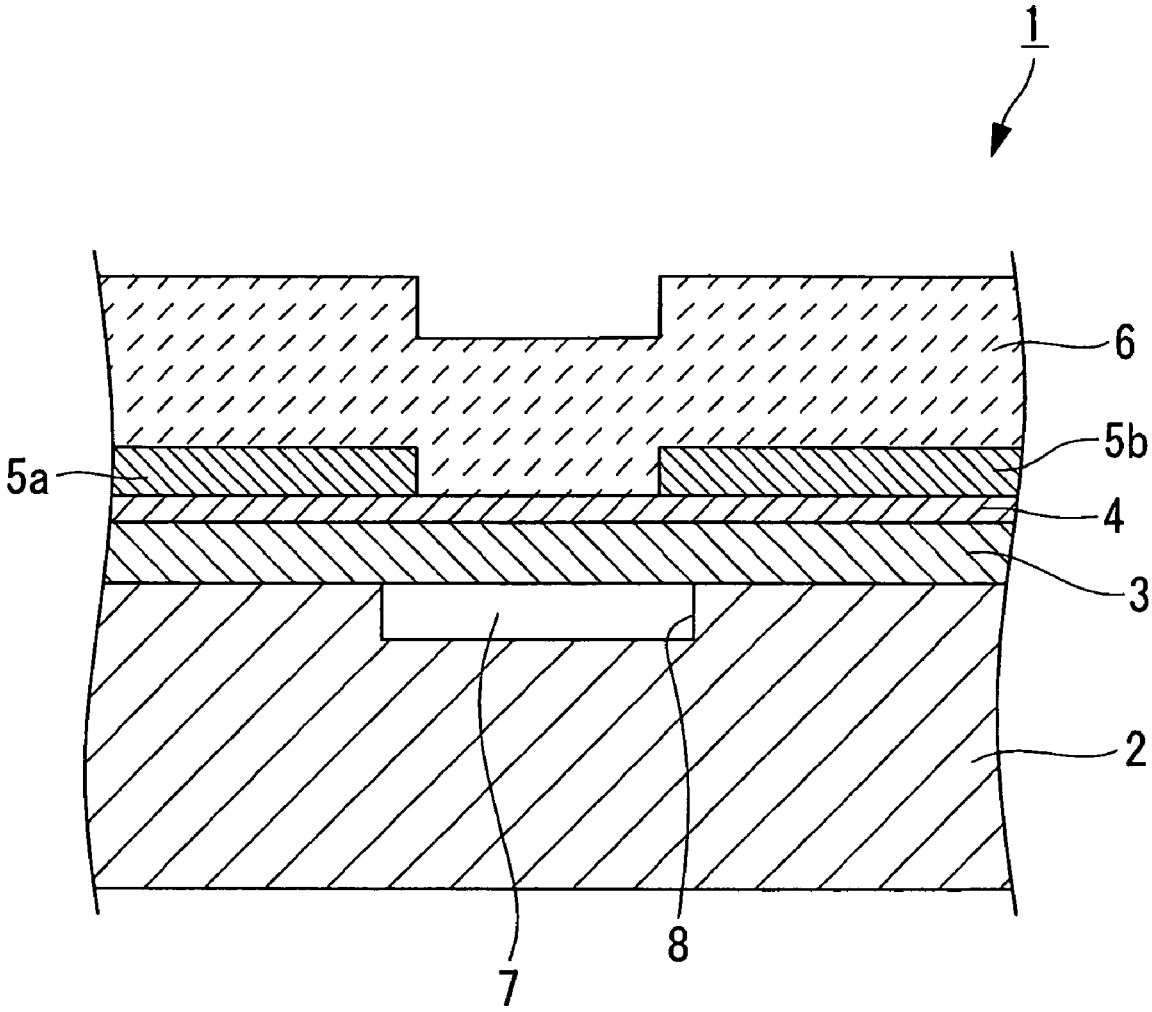
FIG. 2 is a sectional view taken along an arrow II-II of FIG. 1.

As shown in FIG. 2, the thermal head 1 includes a supporting substrate (hereinafter, referred to as "substrate") 2 and an undercoat (insulating film) 3 formed on the substrate 2. As shown in FIG. 1 and FIG. 2, a plurality of heating resistors 4 are formed (arranged) in a zigzag shape along a main scanning direction (horizontal direction in FIG. 1) on the undercoat 3, and are connected with wiring 5. The wiring 5 includes a common wire 5*a* which is connected to one end of the heating resistors 4 in a sub-scanning direction (also referred to as "object-to-be-printed feeding direction") perpendicular to the main scanning direction (also referred to as "arrangement direction") and individual wires 5*b* which are connected to another end thereof. Further, as shown in FIG. 2, the thermal head 1 includes a protective layer 6 which covers top surfaces of the heating resistors 4 and a top surface of the wiring 5.

It should be noted that a portion (hereinafter, referred to as "heating portion") where the heating resistor 4 actually generates heat is a portion which is not overlapped with the wiring 5.

As shown in FIG. 1, in the heating resistance element component 1 according to this embodiment, an arrangement pitch of heating portions of the adjacent heating resistors 4 in the main scanning direction is an ordinary arrangement pitch (arrangement pitch of the conventional case), and a pitch in the sub-scanning direction is made larger than 1 (preferably, 1.3), to thereby form the zigzag shape.

As shown in FIG. 1 and FIG. 2, a surface (upper surface in FIG. 2) of the substrate 2 is formed with concave portions 8 forming hollow portions (a void heat insulating layer) 7.

The concave portion 8 is a concave which is formed such that the hollow portion 7 is located in a region (region opposed to the heating portion) covered with the heating portion of the heating resistor 4, and has a rectangular shape in plan view. The adjacent concave portions 8 are formed so as not to overlap each other. In other words, there is formed a partition wall whose entire surface abuts on a rear surface of the undercoat 3 between the adjacent concave portions 8. In other words, the adjacent concave portions 8 are sectioned (partitioned) with the partition wall. A space formed (enclosed) with a bottom surface (surface parallel to the surface of the substrate 2) and wall surfaces (surfaces perpendicular to the surface of the substrate 2) of the concave portion 8 and a rear surface (lower surface in FIG. 2) of the undercoat 3 forms the hollow portion 7.

Next, a method of manufacturing the thermal head 1 according to this embodiment is described.

First, in a region on the surface of the substrate 2 having a certain thickness, where the heating resistors 4 are formed, the concave portion 8 which forms the hollow portion 7 is processed. As a material of the substrate 2, for example, a glass substrate or a single-crystal silicon substrate is used. A thickness of the substrate 2 is about 300 μm to 1 mm.

The concave portion 8 is formed on the surface of the substrate 2 using sandblasting, dry etching, wet etching, laser processing, or the like.

In the case where the substrate 2 is processed using sandblasting, the surface of the substrate 2 is covered with a photoresist material, and the photoresist material is exposed to light using a photo mask having a predetermined pattern, thereby solidifying a portion other than a region where the concave portion 8 is formed. Then, the surface of the substrate 2 is cleaned to remove the photoresist material which is not solidified, whereby an etching mask having an etching window formed in the region where the concave portion 8 is formed is obtained. The surface of the substrate 2 is subjected to sandblasting in this state, and thus the concave portion 8 which has the predetermined depth is obtained.

In the case where processing is performed through etching, an etching mask having an etching window formed in the region where the concave portion 8 is formed is formed on the surface of the substrate 2 in the same manner, and the surface of the substrate 2 is subjected to etching in this state, whereby the concave portion 8 which has the predetermined depth is obtained. In the etching process, for example, wet etching is performed using an etching liquid of a tetramethylammonium hydroxide solution, a KOH solution, and a mixed liquid of fluorinated acid and nitric acid or the like in the case of the single-crystal silicon, and wet etching is performed using a fluorinated acid etching liquid or the like in the case of the glass substrate. In addition, dry etching such as reactive ion etching (RIE) and plasma etching is performed.

Next, after the etching mask is all removed from the surface of the substrate 2, an insulating material with a thickness of 5 μm to 100 μm is bonded to the surface of the substrate 2, to thereby obtain the undercoat 3 (bonding step). In a state where the undercoat 3 is formed on the surface of the substrate 2 in this manner, the hollow portion 7 is formed between the substrate 2 and the undercoat 3. In this case, the depth of the concave portion 8 is equal to a depth of the hollow portion 7 (in other words, thickness of the void heat insulating layer 7), and hence the thicknesses of the heat insulating layer 7 is easily controlled. As a material of the undercoat 3, for example, glass or a resin is used.

Alternatively, in the case where the undercoat 3 made of thin glass is bonded to the substrate 2 made of glass, bonding is performed using heat fusion in which an adhesive layer is not used. A bonding process of the substrate 2 made of glass and the undercoat 3 made of thin glass is performed at a temperature equal to or higher than an annealing temperature to a temperature equal to or lower than a softening temperature of the substrate 2 made of glass and the undercoat 3 made of thin glass. Therefore, a shape of the substrate 2 and a shape of the undercoat 3 can be maintained with high accuracy, which ensures high reliability.

Here, thin glass having a thickness of about 10 μm is difficult to be manufactured and handled, and is also costly. Thus, in place of bonding the aforementioned thin glass directly to the substrate 2, thin glass having a thickness to be easily manufactured or handled may be bonded to the substrate 2 to be processed so as to have a desired thickness by etching, polishing, or the like. In this case, extremely thin undercoat 3 is formed on one surface of the substrate 2 with ease and at a low cost.

In the etching of thin glass, as described above, various types of etching used in the formation of the concave portion 8 can be used. In the polishing of thin glass, for example, chemical mechanical polishing (CMP) which is used in the high-precision polishing for a semiconductor wafer or the like can be used.

Next, the heating resistors 4, the individual wires 5*b,* the common wire 5*a,* and the protective film 6 are sequentially formed on the undercoat 3 thus formed. It should be noted that the heating resistors 4, the individual wires 5*b,* and the common wire 5*a* are formed in an appropriate order.

The heating resistors 4, the individual wires 5*b,* the common wire 5*a,* and the protective film 6 can be manufactured using a conventional manufacturing method therefor which is conventionally employed in a thermal head. Specifically, a thin film formation method such as sputtering, chemical vapor deposition (CVD), and vapor deposition is used to form a thin film made of a Ta-based or silicide-based heating resistor material on the insulating film, and the thin film made of the heating resistor material is molded using lift-off, etching, or the like, whereby a heating resistor having a desired shape is formed.

Similarly, on the undercoat 3, a wiring material such as Al, Al—Si, Au, Ag, Cu, and Pt is film-formed using sputtering, vapor deposition, or the like to form the film using lift-off or etching, or the wiring material is screen printed and baked thereafter, to thereby form the individual wires 5*b* and the common wire 5*a* which have the desired shape.

After the formation of the heating resistors 4, the individual wires 5*b,* and the common wire 5*a* as described above, a protective film material such as $SiO_2$, $Ta_2O_5$, SiAlON, $Si_3N_4$, or diamond-like carbon is film-formed on the undercoat 3 using sputtering, ion plating, CVD, or the like to form the protective film 6.

According to the thermal head 1 thus manufactured according to this embodiment, the plurality of heating resistors 4 are formed (arranged) in the zigzag shape along the main scanning direction, and the arrangement pitch of the heating resistors 4 in the sub-scanning direction is made larger than the arrangement pitch of the heating resistors 4 in the main scanning direction, with the result that the partition wall which functions as the supporting member which supports pressing force applied from surfaces (upper surfaces in FIG. 2) of the heating resistors 4 is formed between the adjacent concave portions 8.

Accordingly, even when the pressing force is applied from the surface side of the heating resistors 4 during printing or the like, the pressing force is supported by the partition wall formed between the adjacent concave portions 8, whereby the mechanical strength of the substrate 2 can be increased. As a result, the pressure tightness thereof can be increased.

Besides, according to the thermal head 1 of this embodiment, the hollow portions (void heat insulating layers) 7 larger than the conventional hollow portions can be formed (arranged) directly below the heating resistors 4 (in regions opposed to heating portions of the heating resistors 4), and hence heat (amount of heat) generated in the heating resistors 4 can be prevented from flowing into the substrate 2, whereby the heating efficiency of the heating resistors 4 can be increased. As a result, power consumption can be reduced.

Further, in the embodiment described above, when a width of the heating resistors 4 in the main scanning direction is set to equal to or larger than the arrangement pitch of the heating resistors 4 in the main scanning direction, similar effects can be obtained as in the case where the heating resistors 4 are arranged along the main scanning direction without intervals. In other words, a thermosensitive adhesive layer of the sheet material 21 (see FIG. 4) can be thermally activated evenly along the width direction of the sheet material 21.

Still further, according to the thermal head 1 of this embodiment, as shown in FIG. 1, the arrangement pitch of the heating resistors 4 in the sub-scanning direction is set so as to be larger than the arrangement pitch of the heating resistors 4 in the main scanning direction. In addition, the width of the concave portions 8 in the main scanning direction is set so as to be larger than the arrangement pitch of the heating resistors 4 in the main scanning direction, that is, is formed such that the adjacent concave portions 8 overlap each other in the main scanning direction and the sub-scanning direction. As a result, the heat (amount of heat) generated in the heating resistors 4 can be further prevented from flowing into the substrate 2, whereby the heating efficiency of the heating resistors 4 can be further increased and the power consumption can be further reduced.

Figure 3:
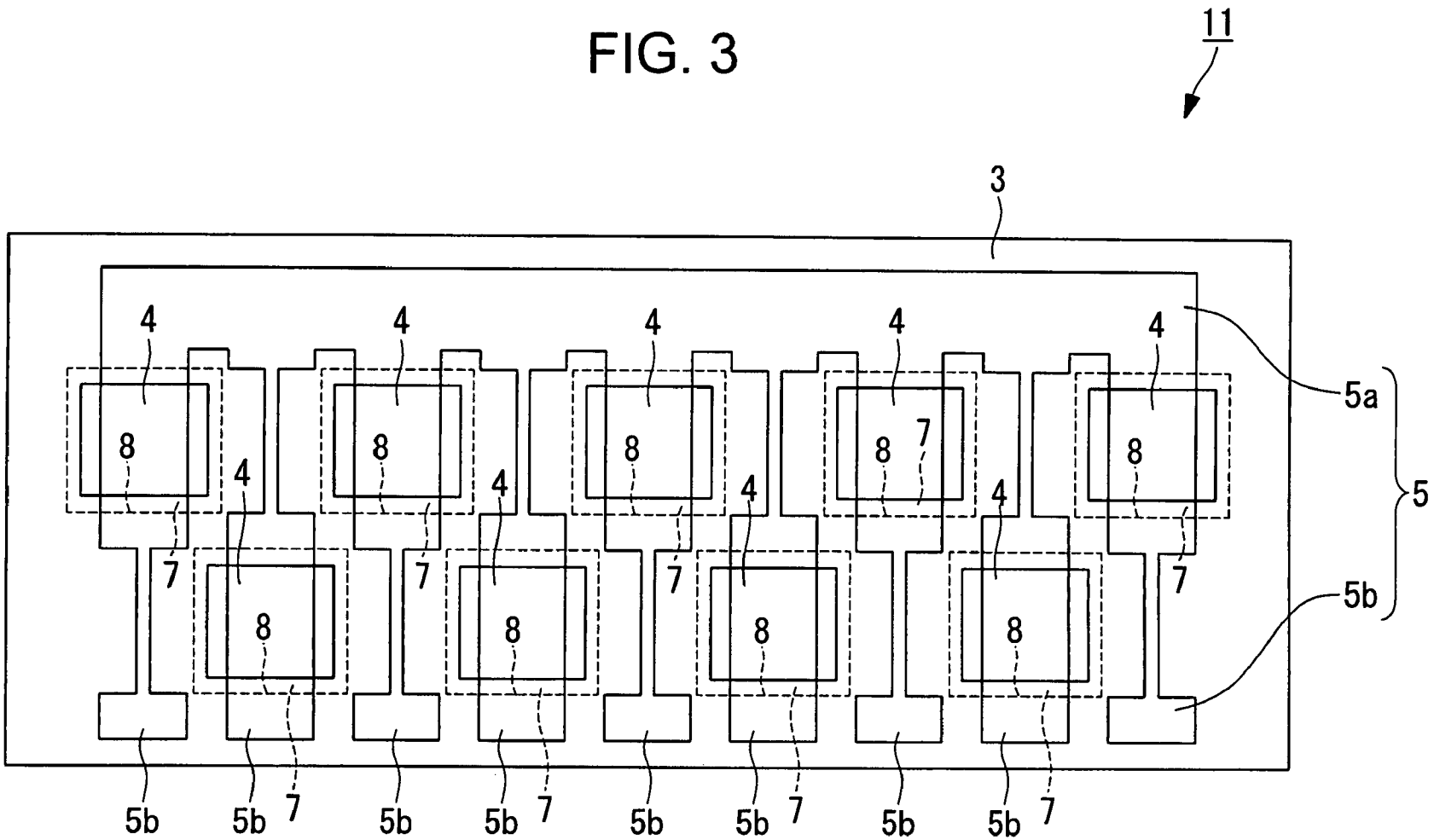
FIG. 3 is a plan view of a thermal head according to a second embodiment of the present invention.

A heating resistance element component according to a second embodiment of the present invention is described with reference to FIG. 3. FIG. 3 is a plan view of a thermal head which is the heating resistance element component according to this embodiment.

A heating resistance element component 11 according to this embodiment is different from the thermal head 1 according to the first embodiment in that the width of the common wire 5*a* or the width of the individual wires 5*b* is smaller in an area adjacent to the heating portions of the heating resistors 4 along the main scanning direction than the width of the common wire 5*a* or the width of the individual wires 5*b* in an area located in the vicinity of the heating portions of the heating resistors 4. Other components are the same as those described above according to the first embodiment, and thus their descriptions are omitted here.

Figure 4:
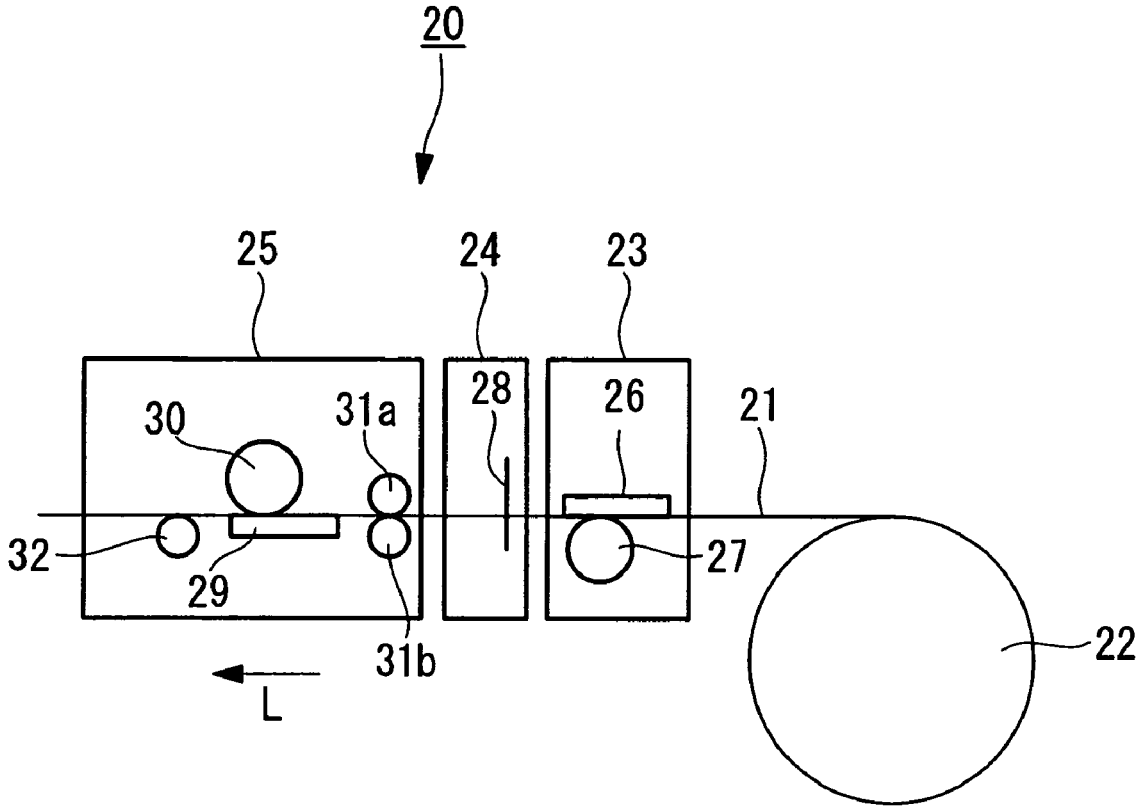
FIG. 4 is a longitudinal sectional view of a printer including the thermal head according to the present invention.

According to the heating resistance element component 11 according to this embodiment, the heating resistors 4 can be in smooth contact with the sheet material 21 (see FIG. 4).

Other operation and effect are the same as those of the thermal head 1 described above according to the first embodiment, and thus their descriptions are omitted here.

It should be noted that the thermal heads according to the present invention are not limited to the thermal heads according to the embodiments described above, and can be modified, changed, and combined with one another, as necessary.

For instance, the concave portion 8 can also be made a through portion (through hole) which pierces the substrate 2 in a plate thickness direction thereof and forms the hollow portion.

When the concave portion 8 is made the through portion, the heat (amount of heat) generated in the heating resistors 4 can be further prevented from flowing into the substrate 2 compared with the embodiment described above, and the heating efficiency of the heating resistors 4 can be further increased compared with the embodiment described above, whereby the power consumption can be further reduced compared with the embodiment described above.

Next, a printer (also referred to as "label issuing apparatus") 20 according to an embodiment of the present invention is described below with reference to FIG. 4.

As shown in FIG. 4, the printer 20 according to this embodiment includes a printing device 23 printing various items of information along a transporting direction of the sheet material 21, which is indicated by an allow L of FIG. 4, on the thermosensitive printing layer of the sheet material 21 supplied from a sheet supplying device 22 around which the sheet material is wound, a cutting device 24 cutting the sheet material 21 printed by the printing device 23, and the thermal activation device 25 for thermally activating the thermosensitive adhesive layer of the sheet material 21.

The sheet material 21 includes a sheet-like base (not shown), the thermosensitive printing layer (not shown) provided on a surface side of the sheet-like base, and the thermosensitive adhesive layer (not shown) provided on a rear surface side of the sheet-like base. It should be noted that, as the sheet material 21, there may be used a sheet material including, between the sheet-like base and the thermosensitive printing layer, a heat insulating layer for cutting off heat transfer from a layer of one side of the sheet-like base to a layer of another side thereof, as necessary.

A so-called thermal printer is used for the printing device 23, and the printing device 23 includes a thermal head 26 for heating the thermosensitive printing layer of the sheet material 21, and a platen roller 27 which is pressed against the thermal head 26. The printing device 23 sandwiches the sheet material 21 supplied from the sheet supplying device 22 between the thermal head 26 and the platen roller 27 to perform printing and transports the sheet material 21. It should be noted that the printing device 23 may be arranged on a downstream side of the sheet material 21 in the transporting direction L where the sheet material 21 is transported by the thermal activation device 25, as necessary. The cutting device 24 includes a cutter 28 for cutting the sheet material 21 transported from the printing device 23 into a desired length, and transports the cut sheet material 21 to the thermal activation device 25.

The thermal activation device 25 includes a thermal activation head 29 for thermally activating the thermosensitive adhesive layer of the sheet material 21, a platen roller 30 which is pressed to the thermal activation head 29 and sandwiches the sheet material 21 between the thermal activation head 29 and the platen roller 30 to transport the sheet material 21 in the transporting direction L, a pair of carrying-in rollers 31*a* and 31*b* for carrying the sheet material 21 transported from the cutting device 24 in the thermal activation device 25, and a carrying-out roller 32 for carrying the sheet material 21 which is thermally activated by the thermal activation head 29 out of the thermal activation device 25.

According to the printer 20 of this embodiment, heating efficiency of the thermal head 1, 11 is high, and hence the thermosensitive adhesive layer of the sheet material 21 can be thermally activated with less electric power. As a result, battery life can be extended.

It should be noted that the thermal head 1, 11 and the printer 20 are described in the embodiments described above, but the present invention is not limited thereto. The present invention can be applied to a heating resistance element component other than the thermal head 1, 11 and a printer other than the printer 20.

What is claimed is:

1. A heating resistance element component, comprising:

a supporting substrate;

an insulating film laminated on the supporting substrate;

a plurality of heating resistors formed on the insulating film, the plurality of heating resistors being arranged in a zigzag shape along a main scanning direction and having a substantially square shape;

a common wire connected to one end of each of the plurality of heating resistors;

individual wires each connected to another end of the each of the plurality of heating resistors; and concave portions formed in regions which are opposed to the plurality of heating resistors and are located on a surface of the supporting substrate, wherein an arrangement pitch of the plurality of heating resistors in a sub-scanning direction is larger than an arrangement pitch of the plurality of heating resistors in a main scanning direction.

2. A heating resistance element component according to claim 1, wherein a width of the plurality of heating resistors in the main scanning direction is equal to or larger than the arrangement pitch of the plurality of heating resistors in the main scanning direction.

3. A heating resistance element component according to claim 1, wherein a width of the concave portions in the main scanning direction is larger than the arrangement pitch of the plurality of heating resistors in the main scanning direction.

4. A heating resistance element component according to claim 2, wherein a width of the concave portions in the main scanning direction is larger than the arrangement pitch of the plurality of heating resistors in the main scanning direction.

5. A heating resistance element component according to claim 1, wherein one of a width of the common wire and a width of the individual wires is smaller in an area adjacent to heating portions of the plurality of heating resistors along the main scanning direction than the one of the width of the common wire and the width of the individual wires in an area located in a vicinity of the heating portions of the plurality of heating resistors.

6. A heating resistance element component according to claim 2, wherein one of a width of the common wire and a width of the individual wires is smaller in an area adjacent to heating portions of the plurality of heating resistors along the main scanning direction than the one of the width of the common wire and the width of the individual wires in an area located in a vicinity of the heating portions of the plurality of heating resistors.

7. A heating resistance element component according to claim 3, wherein one of a width of the common wire and a width of the individual wires is smaller in an area adjacent to heating portions of the plurality of heating resistors along the main scanning direction than the one of the width of the common wire and the width of the individual wires in an area located in a vicinity of the heating portions of the plurality of heating resistors.

8. A thermal activation device comprising a thermal head including the heating resistance element component according to claim 1.

9. A printer comprising the thermal activation device according to claim 8.

* * * * *